US005209096A

United States Patent [19]

Phelps

[11] Patent Number: 5,209,096

[45] Date of Patent: May 11, 1993

[54] LEVER FOR SHEET METAL BRAKES

[76] Inventor: Gordon A. Phelps, 63 Greenleaf Dr., Hampden, Mass. 01036

[21] Appl. No.: 870,919

[22] Filed: Apr. 20, 1992

[51] Int. Cl.[5] ..... B21D 5/04

[52] U.S. Cl. ..... 72/319

[58] Field of Search ..... 72/319-323, 72/316; 269/236, 234

[56] References Cited

U.S. PATENT DOCUMENTS

| | | | |
|---|---|---|---|
| 951,639 | 3/1910 | Frazier | 72/320 |
| 2,434,028 | 1/1948 | Wieland | 72/323 |
| 2,438,319 | 3/1948 | Kilham | 72/319 |
| 2,478,854 | 8/1949 | Webb . | |
| 3,380,280 | 4/1968 | Wise . | |
| 3,481,174 | 12/1969 | Barnack | 72/319 |
| 4,081,986 | 4/1978 | Break | 72/320 |
| 4,240,279 | 12/1980 | Rhoades | 72/319 |
| 4,389,869 | 6/1983 | Van Cleave | 72/319 |
| 4,512,174 | 4/1985 | Rhoades | 72/319 |

FOREIGN PATENT DOCUMENTS

| | | | |
|---|---|---|---|
| 697860 | 11/1964 | Canada | 72/320 |

*Primary Examiner*—Daniel C. Crane
*Attorney, Agent, or Firm*—Donald S. Holland

[57] ABSTRACT

An improved sheet metal brake is disclosed. In the preferred embodiment, the invention basically comprises an elongated rod which attaches to an existing pivotable brake lever. With this extension attached to the brake lever, a user can move the lever extension back-and-forth to open and close the brake. Because the user can now stand in the center of the sheet metal, he can use his body weight to press against the sheet metal to further secure it. This prevents the sheet metal from slipping. As a result, the sheet metal is not bent off-line.

7 Claims, 2 Drawing Sheets

10
14
16
22
26
28
30
32
34
36
38
40
42
44
46
48
50

LEVER FOR SHEET METAL BRAKES

BACKGROUND OF THE INVENTION

The present invention relates to brakes for bending sheet material, such as aluminum sheets and vinyl sheets which are used as siding for buildings and the like.

In U.S. Pat. No. 4,240,279 to Rhoades, a sheet metal brake is disclosed (known in the trade as a "trim brake"), wherein a lever, located on only one end of the trim brake, operates the brake. Consequently, after the user inserts the sheet metal into the machine, and before the operator can return to the appropriate end to activate the trim brake, the sheet metal often slips. If the metal has slipped but the user bends the metal anyway, the metal is bent "off-line". (Ideally, the metal is bent on a line that is parallel to the top and bottom of the sheet metal and perpendicular to the sheet metal's side. If the metal is bent "off-line", then the line is neither parallel nor perpendicular to its appropriate edge.) Afterwards, this sheet metal, which is bent off-line, is hard to install.

This problem might be eliminated if two persons were always available to operate the brake. One person could steady the metal to ensure that it did not slip. The second person could activate the brake. Unfortunately, there are rarely instances where an extra person can be spared to assist with this process.

Accordingly, it is the primary object of the present invention to provide an improved lever for trim brakes, which will eliminate the possibility that the sheet metal will be bent off-line.

It is another object to provide a brake lever extension which is lightweight and durable and does not interfere with the overall portability of the brake.

It is yet another object to provide a lever extension which does not require two persons to operate in order to prevent the sheet metal from slipping, such that the sheet is bent off-line.

It is still a further object to provide an improved trim brake lever which can open and close the brake from any point along the platform, rather than at just one end of the platform.

It is yet another object to provide an improved lever, commensurate with the above-listed objects, that can be retrofitted onto an existing machine, or, which can be manufactured as part of the original brake.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented an improved trim brake lever. It is designed to be used with many standard sheet-metal trim brakes.

In the preferred embodiment, the invention comprises a lever extension, which activates the trim brake, and which is pivotally attached to the brake lever. The illustrated lever extension basically comprises an elongated aluminum rod or tube which extends along the entire length of the brake platform and which is attached to the trim brake by surrounding U-clamps at spaced intervals. These U-clamps are located on the upper arms of the C-shaped members of the trim brake. These clamps hold the lever, but permit it to slide in one direction or the other, to push or pull the lever, thereby opening or closing the brake. This brake lever extension allows its user to activate the brake lever at any point along the platform. Because the user can open or close the brake from any point, the user can close the brake before the sheet metal slips. As a result, the sheet metal is not bent off-line.

DETAILED DESCRIPTION OF THE PREFERRED EMBODIMENT

Figure 1:
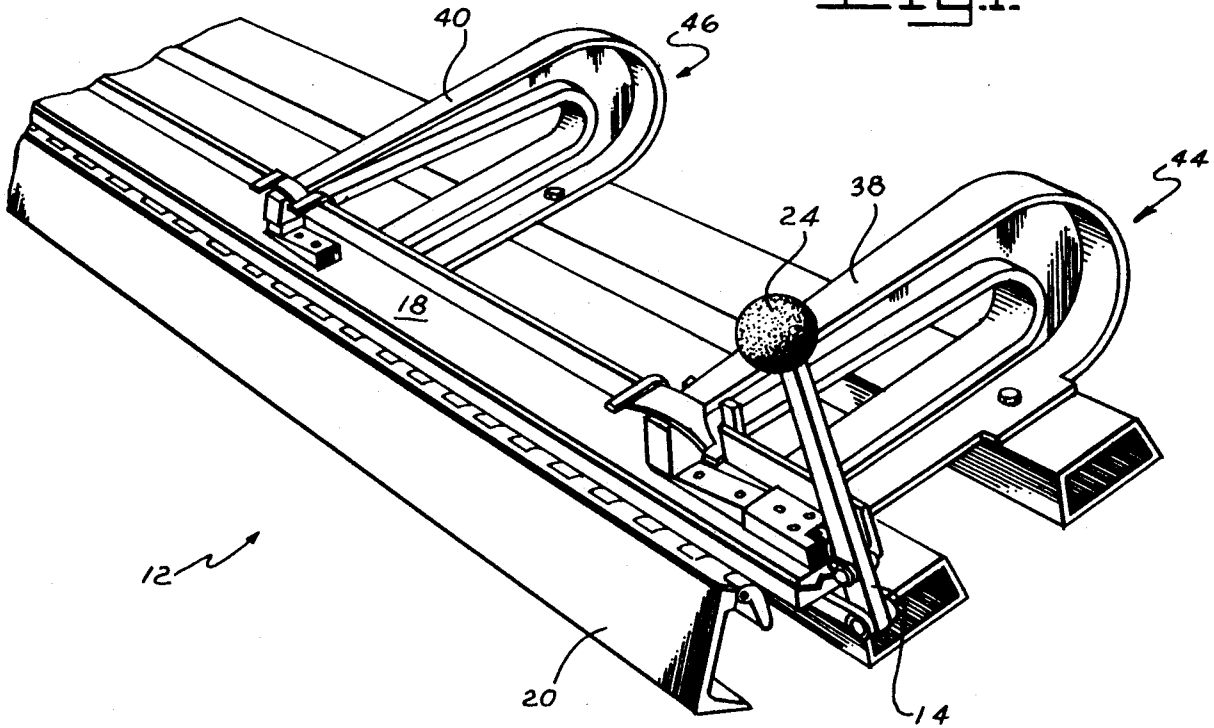
Prior Art Fig. 1.
FIG. 1 is a top perspective view of a trim brake machine disclosed in U.S. Pat. No. 4240279 to Rhoades.

Referring to the drawings in detail, the preferred embodiment of a trim brake lever is shown and generally designated by the reference numeral 10. See FIGS. 2-5. The invention basically comprises a standard trim brake 12 which has a brake lever 14 (see FIG. 1) with an additional element: an elongated rod 16 which is attached to the brake lever 14 and acts as an extension to the lever 14. See FIGS. 2, 4, 5.

There are several trim brake machines 12 which are widely used today. One brake 12, shown in FIG. 1, is currently manufactured by the TAPCO® Company, located in Detroit, MI. The brake 12 in FIG. 1 was disclosed and claimed in U.S. Pat. No. 4,240,279 to Rhoades. That patent is hereby incorporated by reference. Typically, brakes 12 are made of lightweight, durable materials, such as aluminum. These brakes 12 have a brake lever 14 at one end of the brake 12. In the operation of the Rhoades patent, the lever 14 is shifted towards the right, to its open position, to allow the insertion of a sheet of metal (not shown). After the metal is inserted, the lever 14 is then shifted to the left, to a closed position. Referring to FIG. 1, this closed position causes a pressure member 18 to become wedged downwardly onto an anvil member (not shown) so as to clamp the sheet material which has been inserted between the anvil member and another member 20. After the metal is clamped, member 20 is swung upwardly through a handle 22, which bends the metal appropriately. Finally, the clamp is released by returning the lever 14 to its original (open) position. See FIG. 4, which illustrates both the handle 22 and the brake in an open position.

In the preferred embodiment of the present invention, a brake lever extension 16 is attached to the brake lever 14. Although Applicant illustrates the invention attached to only one existing trim brake, it could be attached to many existing trim brakes in the marketplace. The extension 16 is a lightweight rod or tube made of any suitable material such as aluminum. In its preferred embodiment, the design of the extension 16 does not interfere with overall portability of the brake 10 or its durability.

Figures 2, 3, 4, 5:
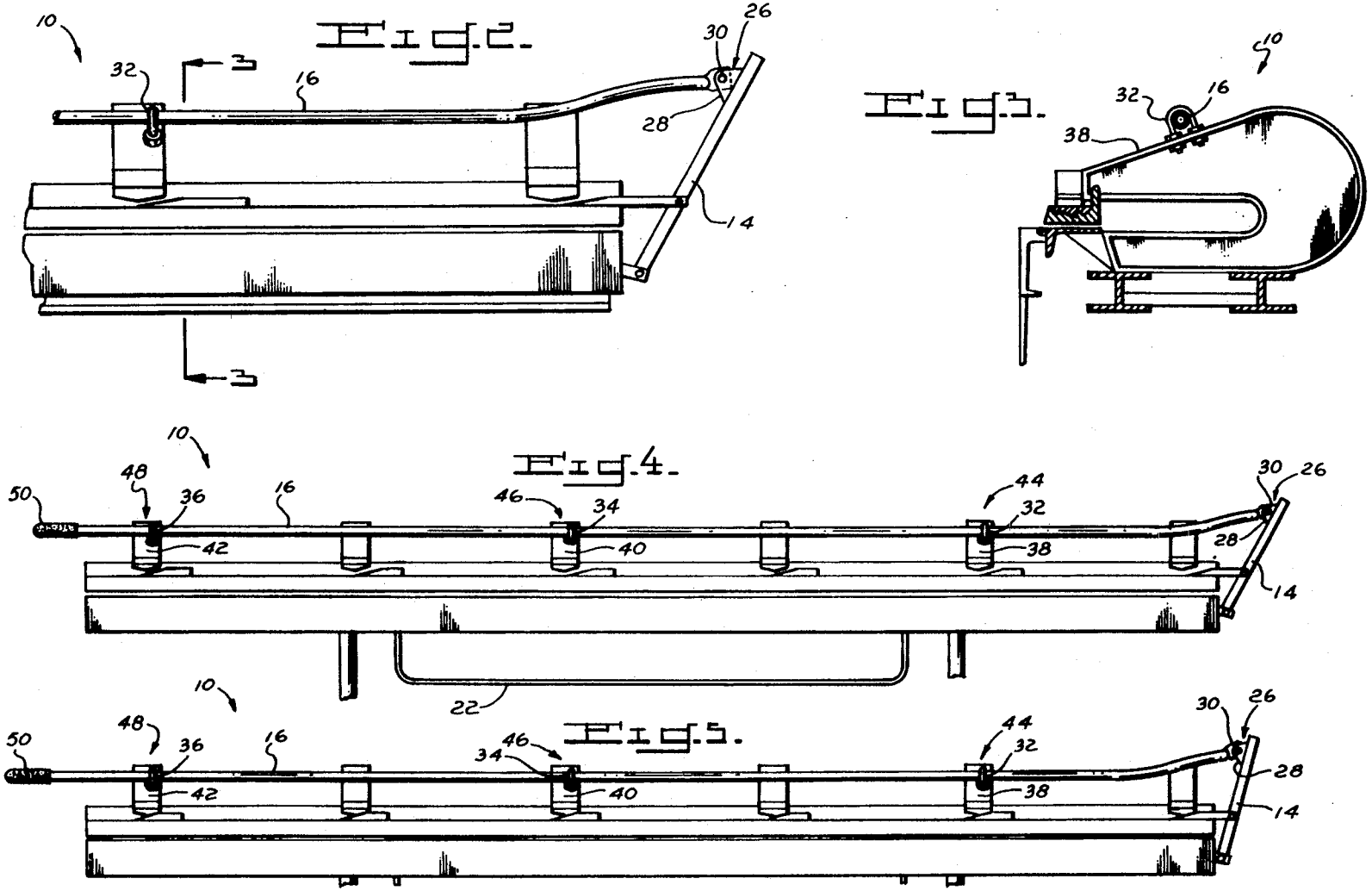
FIG. 2 is a fragmentary front plan view (with portions broken away) of a brake lever extension constructed in accordance with the present invention and attached to an existing brake, such as the Rhoades trim brake of FIG. 1.
FIG. 3 is a cross-sectional view, taken along lines 3—3 of FIG. 2, showing a C-shaped member of the brake.
FIG. 4 is a front plan view (with portions broken away) of the brake in an open position, showing the upper arms of the C-shaped members, the lever extension inside U-clamps and a handle.
FIG. 5 is a front plan view (with portions broken away) of the brake in a closed position

The extension 16 extends the length of the brake 12 and attaches to any existing brake lever 14 by any suitable means. In the preferred embodiment, the brake extension 16 is an aluminum tube, which attaches to the lever 14 after the balled-portion 24 is removed. (FIG. 1 shows the balled-portion 24 as it is used in the prior art. FIGS. 2, 4, 5 show the lever 14 without its balled-portion 24.) An anchor pin connector 26 comprised of two spaced "ears", such as 28, attaches to the existing brake lever 14. Each of these "ears" has a corresponding hole (not shown).

Referring to FIGS. 2, 4, 5, the right-hand side of the brake lever extension 16 is adapted in size and shape to accommodate the anchor pin connector 26. (Facing the drawings, the right-hand side of the page corresponds to the right-hand side of the invention. Conversely, the left-hand side of the page denotes the left-hand side of the invention.) The right-hand end of the extension 16 is flattened and inserted between the two ears, such as 28. The extension 16 has a hole (not shown) which aligns with central holes (not shown) in those ears of the anchor pin connector 26. Then, an anchor pin 30 is placed through the hole of one ear, such as 28, through the hole in the extension 16, and finally through the hole in the other ear (not shown). After the pin 30 is inserted properly, the brake lever extension 16 is pivotally secured to the brake lever 14.

As shown in FIGS. 2, 4, 5, the lever extension 16 slopes downwardly so that it can be attached to an existing brake machine 12. The lever extension 16 is attached by any suitable means, such as U-shaped bolts 32, 34, 36 which are attached to their respective upper arms 38, 40, 42 of their corresponding C-shaped members 44, 46, 48. These U-shaped bolts 32, 34, 36 leave ample room for brake lever extension 16 to move freely back and forth.

The left-hand side of the brake extension 16 has a protective covering, or grip, 50, which protects the user from any jagged edges of the lever extension 16. The grip 50 can have a grooved surface (not shown) to accommodate a user's grasp.

Due to Applicant's invention, the brake 12 can be opened or closed by either of two methods. First, the user can push the lever 14 itself, which mandates the user be positioned within reach of the lever 14. Or, due to Applicant's invention, the user can push the lever extension 16. With the lever extension 16, the user can position himself at any point along the machine 10, not just one end. Because the user does not have to be at one end of the brake 10 to operate it, he can insert the sheet metal and quickly pull the lever extension 16. Consequently, the user can clamp the sheet metal before it slips. Thus, Applicant's invention 10 prevents the sheet metal from bending off-line. In addition, the user can position himself at the sheet metal's center and use his body weight to press against the sheet metal for added stability. Without the lever extension 16, the user could not position himself in the center of the sheet metal (if the sheet was quite large) and reach the lever 14.

The invention in its preferred embodiment can be retrofitted to an existing trim brake 12. In addition, it can be installed as an original piece.

In alternate embodiments (not shown), Applicant envisions that something flexible, such as a cord or strong string, could be attached to the lever, instead of an inflexible rod. With this embodiment, the user would not have to use U-clamps or guides. In another embodiment, a plurality of levers (such as one on each end of the brake) could be used. Further, a plurality of levers and a plurality of extensions could be used.

It should be understood by those skilled in the art that obvious modifications can be made without departing from the spirit of the invention. Accordingly, reference should be made to the accompanying claims, rather than the foregoing specifications, to determine the scope of the invention.

Having thus described the invention, what is claimed is:

1. In a brake for bending sheet metal of the type having an anvil member for supporting the sheet metal, a clamp member adjustably secured adjacent the anvil member, at least on C-shaped member that secures the anvil member adjacent to the clamp member so that sheet metal may be adjustably secured between the anvil and clamp members, a bending member pivotally secured to the anvil member for bending secured sheet metal, said clamp member having an edge extending along an axis about which the bending member bends the sheet metal, said edge having a predetermined length, and a lever pivotally secured to the clamp member for adjusting the clamp member to secure the sheet metal against the anvil, the improvement comprising a hand-operated extension pivotally attached to the lever and movable along a path parallel to the axis of said clamp member, wherein the extension extends parallel to the axis of said clamp member substantially along the entire edge length so that its user may adjust the lever by manipulating the extension at substantially any point along the length of said clamp member edge to actuate the clamp member.

2. In a brake for bending sheet metal of the type having an anvil member for supporting the sheet metal, a clamp member adjustably secured adjacent the anvil member, at least one C-shaped member that secures the anvil member adjacent to the clamp member so that sheet metal may be adjustably secured between the anvil and clamp members, a bending member pivotally secured to the anvil member for bending secured sheet metal, said clamp member having an edge extending along an axis about which the bending member bends the sheet metal, said edge having a predetermined length, and a lever pivotally secured to the clamp member for adjusting the clamp member to secure the sheet metal against the vanilla, the improvement comprising a hand-operated rod attached to the lever and movable along a path parallel to the axis of said clamp member, wherein the rod extends parallel to the axis of said clamp member substantially along the entire edge length so that is user may adjust the lever by manipulating the rod at substantially any point along the length of said clamp member edge, to secure the sheet metal, and the hand-operated, elongated rod travels through at least one guide attached to the brake.

3. The brake for bending sheet metal of claim 2, wherein there are a plurality of guides at spaced intervals along the brake, through which the hand-operated rod travels, and the guides are comprised of U-shaped clamps attached to respective C-shaped members.

4. The brake for bending sheet metal of claim 3, wherein the hand-operated rod is pivotally attached to the lever.

5. The brake for bending sheet metal of claim 4, wherein the hand-operated rod is pivotally attached to the lever by an anchor pin and an anchor pin connector, and the anchor pin connector has at least one ear whereby an anchor pin can be inserted through corresponding holes in the ear and the lever extension.

6. The brake for bending sheet metal of claim 3, wherein the hand-operated rod has a protective overlying grip, adapted in size and shape to accommodate a user's hand, and the grip is located on the rod at an opposite end to a rod end attached to the lever.

7. In a brake for bending sheet metal of the type having an anvil member for supporting the sheet metal, a clamp member adjustably secured adjacent the anvil member, at least one C-shaped member that secures the anvil member adjacent to the clamp member so that sheet meal may be adjustably secured between the anvil and clamp members, a bending member pivotally secured to the anvil member for bending secured sheet metal, said clamp member having an edge extending along an axis about which the bending member bends the sheet metal, said edge having a predetermined length, and a lever pivotally secured to the clamp member for adjusting the clamp member to secure the sheet metal against the vanilla, the improvement comprising hand-operated lever extension means movable along a path parallel to the axis of said clamp member for allowing its user to move the lever by pulling the hand-operated lever extension mans in the direction of said path at substantially any point along the length of said clamp member edge, wherein the lever extension means is pivotally attached to the lever and extends parallel to the axis of said clamp member substantially along the entire edge length.

* * * * *